United States Patent [19]

Mertens-Gottselig et al.

[11] Patent Number: 5,024,678

[45] Date of Patent: Jun. 18, 1991

[54] PROCESS FOR THE PREVENTION OR REDUCTION OF DEPOSITS IN CARBURETORS, INJECTION DEVICES AND SIMILAR DEVICES OF ENGINES

[75] Inventors: Dagmar Mertens-Gottselig, Frechen-Bachem; Hartmut Hammer, Cologne; Heinrich Muller, Wesseling; Manfred Wildersohn, Eschweiler, all of Fed. Rep. of Germany

[73] Assignee: DEA Mineralol Aktiengesellschaft, Hamburg, Fed. Rep. of Germany

[21] Appl. No.: 177,623

[22] Filed: Apr. 5, 1988

[30] Foreign Application Priority Data

Apr. 9, 1987 [DE] Fed. Rep. of Germany ..... 3711985

[51] Int. Cl.[5] ..... C10L 1/18; C10L 1/22

[52] U.S. Cl. ..... 44/348; 44/347; 44/387; 44/400; 44/417; 44/418; 44/423; 44/435; 44/448; 44/451; 44/452

[58] Field of Search ..... 44/76, 72, 77, 71, 347, 44/348, 387, 400, 418, 435, 451, 452

[56] References Cited

U.S. PATENT DOCUMENTS

| | | | |
|---|---|---|---|
| 2,655,440 | 10/1953 | Barusch et al. | 44/77 |
| 2,763,537 | 9/1956 | Barusch et al. | 44/77 |
| 2,807,525 | 9/1957 | Foreman | 44/77 |
| 2,807,526 | 9/1957 | Foreman | 44/77 |
| 3,440,029 | 4/1969 | Little et al. | 44/72 |
| 3,478,096 | 11/1969 | Cyba | 44/72 |
| 3,849,083 | 11/1974 | Dubeck | 44/72 |
| 3,960,965 | 6/1976 | Battersby et al. | 44/72 |
| 3,980,450 | 9/1976 | Battersby et al. | 44/72 |
| 4,236,020 | 11/1980 | Lewis et al. | 44/71 |
| 4,409,001 | 11/1983 | Sung et al. | 44/71 |
| 4,427,562 | 1/1984 | Horadysky et al. | 44/71 |
| 4,428,354 | 11/1984 | Sung et al. | 44/71 |
| 4,527,996 | 7/1985 | Campbell | 44/72 |
| 4,565,549 | 1/1986 | Mathiesen et al. | 44/77 |
| 4,778,481 | 10/1988 | Courtney | 44/71 |

*Primary Examiner*—Prince E. Willis
*Assistant Examiner*—E. McAvoy
*Attorney, Agent, or Firm*—Connolly and Hutz

[57] ABSTRACT

Process for the prevention of reduction of deposits in carburetors, injection devices or similar devices of engines, which are operated with alcohol fuels comprising 99.9 to 75 Vol.-% methanol, ethanol or a mixture thereof and at least one corrosion inhibitor characterized in that one or several polyol ethers are added to the alcohol fuels in a quantity of 15 ppm up to 1 weight-%, whereby the polyol ether(s) has (have) the general formula

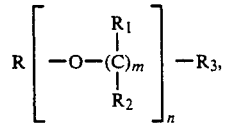

wherein R is H, linear or branched $C_1$–$C_{20}$-alkyl, $C_1$–$C_{20}$-alkenyl, polyunsaturated $C_1$–$C_{20}$- alkyl, $C_1$–$C_{20}$- cycloalkyl, mono- or bicyclo-$C_6$–$C_{14}$-aryl, unsubstituted or substituted, $R_1$ is H, $C_1$–$C_8$-alkyl, unsubstituted or substituted aryl, $R_2$ is H, $C_1$–$C_8$-alkyl, unsubstituted or substituted aryl, and $R_3$ is $OR_5$, $SR_5$, $N(R_5)_2$, wherein $R_5$ is H, linear or branched $C_1$–$C_{20}$-alkyl, $C_1$–$C_{20}$-cycloalkyl, mono- and bicyclo-$C_6$–$C_{14}$-aryl, unsubstituted or substituted or other specified acid ester or amide substituents and m of the polyolether molecule is 2 or 3 or 4 or combinations of these numbers and n is 2–200.

37 Claims, No Drawings

PROCESS FOR THE PREVENTION OR REDUCTION OF DEPOSITS IN CARBURETORS, INJECTION DEVICES AND SIMILAR DEVICES OF ENGINES

BACKGROUND OF THE INVENTION

This invention relates to a process for the prevention or reduction of deposits in carburetors, injection devices and similar devices of engines, which are operated with alcohol fuels in combination with lubricants, which are suitable for engines operated with hydrocarbon-fuels.

PRIOR ART

During recent years alcohols, in particular methanol and ethanol have been intensely investigated with regard to their use as motor-fuels (see for example EP-A-166096). In the meantime a high degree of technical development has been achieved. This is also the case regarding motor-cars which are fuelled by these alcohol fuels.

However problems still exist related to the formation of deposits in carburetors, injection devices and similar devices if alcohol fuels are used in combination with lubricants, which are suitable for engines operated with hydrocarbon fuels like gasoline and diesel fuel.

For this reason, motor cars operated with alcohol fuels, in particular with fuels containing more than 75 Vol.-% of alcohol are until today lubricated with lubricants, which have been specifically developed for these alcohol fuels.

SUMMARY OF THE INVENTION

The investigations of applicant have led to the non-obvious result, that such deposits in carburetors, injection devices or similar devices of engines, which are operated with fuels based on methanol and/or ethanol -and which optionally may contain additives like water and/or $C_3$–$C_{10}$-alcohols and/or other oxygen containing compounds and/or hydrocarbons and at least one corrosion inhibitor-, in combination with lubricants, which are suitable for engines operated with hydrocarbon fuels, are prevented or reduced, if one or several polyolethers are added to the alcohol fuels in a quantity of 15 ppm up to 1 weight-%, whereby the polyolether(s) has (have) the general formula

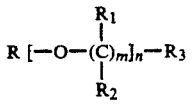

wherein R is H, linear or branched $C_1$–$C_{20}$-alkyl, $C_1$–$C_{20}$-alkenyl, polyunsaturated $C_1$–$C_{20}$-alkyl, $C_1$–$C_{20}$-cycloalkyl, mono-or bicyclo-$C_6$–$C_{14}$-aryl with or without functional groups like OH, $OR_4$, $NH_2$, alkylamine, SH, $SR_4$, C≡N (whereby $R_4$ is a saturated or unsaturated $C_1$–$C_{20}$-alkyl group or a substituted or unsubstituted arylgroup), an O—, S— or P-containing group like carboxy groups of aliphatic saturated or unsaturated carboxylic acids, in particular of fatty acids, of aromatic substituted and unsubstituted carboxylic acids, phosphoric ester groups, thiophosphoric ester groups and acetal groups;

wherein $R_1$ is H, $C_1$–$C_8$-alkyl, unsubstituted or substituted aryl;

wherein $R_2$ is H, $C_1$–$C_8$-alkyl, unsubstituted or substituted aryl and wherein $R_3$ is $OR_5$, $SR_5$, $N(R_5)_2$, wherein $R_5$ is H, linear or branched $C_1$–$C_{20}$-alkyl, $C_1$–$C_{20}$-alkenyl, polyunsaturated $C_1$–$C_{20}$-cycloalkyl, mono- and bicyclo-$C_6$–$C_{14}$-aryl with or without functional groups like OH, $OR_4$, $NH_2$, alkylamin, SH, $SR_4$, C≡N, (wherein $R_4$ is a saturated or unsaturated $C_1$–$C_{20}$-alkyl or unsaturated or saturated aryl); or

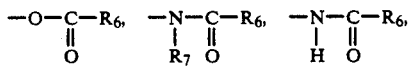

wherein $R_6$ is H, a linear or branched, saturated or unsaturated $C_1$–$C_{20}$-alkyl- or mono- or bicycloalkyl group or a substituted or unsubstituted mono- or bicycloaryl group, an unsubstituted or substituted amino group, a substituted or unsubstituted alkoxy group, a substituted or unsubstituted thioether group, wherein $R_7$ is a linear, branched, saturated or unsaturated alkyl group, or

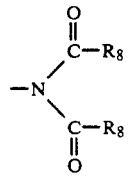

wherein $R_8$ is $R_6$ and the C=O groups may be interconnected by unsubstituted or substituted saturated or unsaturated methylene bridges consisting of 2–5 methylene groups, or phosphoric esters or alkylethylene diamino tetra acetic acid ester, -amid or -imid whereby m of the polyolether molecule exclusively is 2 or 3 or 4 or combinations of these numbers, and n is 1–200.

The inventive result was in particular surprising and non-obvious, because only a small quantity of polyolether, which is dissolved in the alcohol fuel and which is present in for example a carburetor in a finely divided mixture with air, is sufficient for prevention of deposits in the carburetor.

PREFERRED EMBODIMENTS

According to the invention, polyolether is added to the alcohol fuel in a quantity of 15 ppm up to 1 weight-% based on the total quantity of fuel, preferably of 15 to <2000 ppm and particularly preferable of 30 to <2000 ppm.

Preferred polyolethers used, contain ethylene oxide or propylene oxide units or mixtures of these, whereby the number n of the polyol units is 1 to 200, preferably 2 to 100 and particularly preferable 2–75; n is, as generally an average number.

The substituents $R_1$ and $R_2$ may also be higher alkyl groups of 2 to 8 C-atoms, or aryl groups. Polyolethers according to the instant invention may also be produced from tetrahydrofurane respectively its derivatives (m=4) or trimethylene oxide respectively its derivatives (m=3) or may be mixed polymerization products with di-, tri- and tetramethylene units or their derivatives.

The groups R and $R_3$ have been identified above. Preferred groups, represented by R, are H, alkyl, aryl and carboxy. Preferred $R_3$-groups are H, $OR_5$, $SR_5$, $NHR_5$, $N(R_5)_2$,

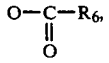

and

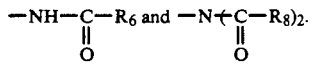

The polyolether groups are selected considering that the polyolethers should be soluble in the particular alcohol or alcohol blend.

Preferred fuels according to the instant invention are fuels, which contain 0,1 to 25 Vol.-%, preferably 1 to 25 Vol.-% and particularly preferable 2 to 25 Vol.-% of hydrocarbons and 75 to 99,9 Vol.-% methanol and/or ethanol, preferably 75 to 99 Vol.-% and particularly preferable 75 to 98 Vol.-% of methanol and/or ethanol and/or any blend of methanol and ethanol. The hydrocarbons added, are preferably $C_4$-$C_x$-hydrocarbons, wherein x corresponds to the number of carbon atoms of the hydrocarbons boiling at the upper limit of gasoline-hydrocarbons.

The alcohol fuels may also be free of hydrocarbons. By the inventive addition of polyolethers, deposits are prevented also, if blends are used, which contain alcohol concentrations of less than 75 Vol.-%, for example only 50 Vol.-% or even less.

The lubricants used, usually are present in a separate lubricating system, however in principle they can also be added directly to the fuels, if a homogenous solution is achieved.

Very good inventive results are obtained for example, with fuels based on methanol and/or ethanol, respectively their blends, which contain 0,1 to 15 weight.-%, preferably 2 to 15 weight-% of $C_4$–$C_5$, respectively $C_4$–$C_6$-hydrocarbons, whereby in the case of methanol up to 15 weight-% of water and in the case of ethanol up to 25 weight-% of water may be present in the blend.

The ratio $C_4$:$C_5$ respectively of $C_4$:$C_5$/$C_6$ is 1:500 to 3:1 parts by weight, preferably 1:1 to 1:20.

Also very good results are obtained with $C_4$–$C_7$-hydrocarbons, whereby 0,1 to 18 weight-%, preferably 2 to 18 weight-% of hydrocarbons are present in the fuel-blend. The ratio of $C_4$:$C_5$–$C_7$ is 1:500 to 3:1 parts by weight, preferably 1:1 to 1:20 parts by weight.

Also addition of mixtures of $C_4$-hydrocarbons and hydrocarbons boiling in the gasoline range yields very good results.

In this case 0,1 to 25 weight-%, preferably of 2 to 25 weight-% of the hydrocarbons are added, with a ratio of $C_4$:gasoline of 1:500 to 3:1 parts by weight, preferably of 1:1 to 1:20 parts by weight.

However very good results are also obtained, if hydrocarbons are added which contain only little or no $C_4$-hydrocarbons, for example summer-grade gasoline, light gasoline fractions, platformer fractions, pyrolysis gasoline fractions (from ethylene units), Merox-gasoline fractions, alkylation- and polymer-gasoline-fractions and other typical refinery fractions.

In all these cases methanol fuels may contain up to 15 weight-% of water and ethanol fuels up to 25 weight-% of water. Mixtures may contain intermediate quantities of water.

Suitable alcohols may be pure or crude qualities. In the case of methanol for example, pure methanol, crude or topped methanol may be used or in the case of ethanol, distilled ethanol, which may be free of water or may contain the quantity of water of the azeotropic ethanol/water mixture or may contain even more water and typical contaminations, may be used. Such quantities of water and contaminations often remain in ethanol grades, which are produced from bioethanol.

The fuels may contain additional quantities of aromatics, for example $C_6$–$C_8$-aromatics or platformate, as well as additives like ethers, for example dimethylether, methyl-tert.-butyl-ether, methyl-tert.-amylether and others, or ketones like for example acetone.

Additional alcohols like isomers of $C_3$–$C_{10}$-alcohols, in particular $C_3$- and $C_4$- alcohols may also be components of the fuel blends.

The added hydrocarbons are preferably refinery fractions with the boiling range desired. Such fractions may be $C_4$–$C_6$-, $C_4$–$C_7$-, $C_4$-$C_5$-$C_6$, $C_5$-$C_7$ or naphtha-, respectively gasoline-fractions, respectively their combinations.

According to the invention, deposits are prevented respectively reduced also, in the case where typical additives like corrosions inhibitors are present in the fuel. Typical corrosion inhibitors may be for example the following compounds, their derivatives or mixtures of these compounds: imidazoline, glycylamide, aliphatic mono-, di- and polyamines and their N-substituted derivatives, ethylendiamine, succinic acid, alkenyl succinic acid, and its polymers, alkanol amine, monomers and polymers of unsaturated aliphatic carboxylic acids, like for example oleic acid, linolic acid, aliphatic dicarboxylic acids, oxalic acid to $C_{20}$-dicarboxylic acids, polyalkylene polyamines, triazoles, amino triazoles, triazolines, amino triazolines, benzoic acid and its salts, morpholine, organic phosphoric acid derivatives, salts of organic saturated and unsaturated carboxylic acids, carboxylic acid anhydrides, alkoxy-alkylamines, nitrogen containing condensation products, boron containing compounds, amphoteric nitrogen compounds, aryltriazol-compounds and others.

According to the invention the fuels may contain additional additives like emulsifiers, ignition control additives, anti-rust additives, anti-wear agents and others.

The invention is further illustrated by the following examples.

EXAMPLES

EXAMPLE 1

A VW (Volkswagen) -Jetta with a 90 PS carburetor engine was operated at average conditions, at extreme conditions, like very high summer temperatures and very low winter temperatures (35° C. to −30° C.) as well as with cold engine- and short-distance conditions. The fuel used consisted of 90 weight-% of methanol and 10 weight-% of a mixture of a small $C_4$-fraction and gasoline. As a corrosion inhibitor an amphoteric, nitrogen-containing condensation-product was used. 200 to 500 ppm of the following polyolether were added to the fuel $$H_3C\,[-O-CH_2-CH_2-]_4\,OCH_3$$

A conventional lubricant of the SAE 15W40-type was used. After a distance of 2500 km respectively, the carburetorsystem was investigated with regard to deposits. After a total of 25.000 km no deposits, even in traces, were observed. In a comparative example, the same tests were carried out with After termination of the test, deposits were found in the throttle valve area.

EXAMPLE 2

Test 1 was repeated with the following polyolether $$H_3C\text{-}(O\text{-}CH_2\text{-}\underset{\underset{CH_3}{|}}{CH})_{16}\text{-}OCH_3$$

which was added to the fuel in a quantity of 100 ppm. After termination of the test the carburetor was perfectly clean.

EXAMPLE 3

Test 1 was repeated, whereby the following polyolether was added in a quantity of 1500 ppm $$H_5C_2\text{-}(O\text{-}CH_2\text{-}\underset{\underset{CH_3}{|}}{CH})_{110}\text{-}O\text{-}\overset{\overset{O}{\|}}{C}\text{-}(CH_2)_7\text{-}CH{=}CH\text{-}(CH_2)_7\text{-}CH_3$$

After termination of the test, the carburetor was perfectly clean.

EXAMPLE 4

Test 1 was repeated with a vehicle having an injection system. The fuel used consisted of 85 weight-% of methanol and 15 weight-% of gasoline free of lead. As a lubricant a commercial SAE 20W50-type was used.

As a polyolether a mixed polymer consisting of propylenoxide and ethylene oxide was used, with terminal methylether-groups, with n=10 and a terminal p-cresol group (R), as well as a terminal succinimide group and n=75.

After termination of the tests, the carburetor was perfectly clean. In comparative tests, deposits were observed in the injection system.

EXAMPLE 5

Test 1 was repeated. The fuel used consisted of 3 parts by weight of methanol and 1 part of ethanol, blended with 10 weight-% of $C_4$-hydrocarbons (10 weight-% based on the total hydrocarbon fraction)+a refinery fraction essentially consisting of $C_5$-$C_7$-hydrocarbons.

The polyolether used, consisted of ethylene oxide units with n=4, a terminal isooctylether group and a hydroxy group.

After termination of the test, carburetor and injection system were perfectly clean.

EXAMPLE 6

Test 1 was repeated. The fuel consisted of 80 weight-% of methanol and 20 weight-% of premium gasoline. Polyolether $$HO\text{-}\underset{\underset{CH_3}{|}}{CH}\text{-}CH_2\text{-}O\text{-}(\underset{\underset{CH_3}{|}}{CH}\text{-}CH_2\text{-}O)_{140}\text{-}\underset{\underset{CH_3}{|}}{CH}\text{-}CH_2\text{-}OH$$

was added in a quantity of 1700 ppm.

After termination of the test, the carburetor was perfectly clean.

EXAMPLE 7

Test 1 was repeated. The fuel consisted of 80 weight-% of methanol, 5 weight-% of water and 5 weight-% of a light gasoline fraction (60°-110° C. boiling range).

As a polyolether, 800 ppm of the following product were added $$HO\text{-}(CH_2)_4\text{-}O\,[\text{-}(CH_2)_4\text{-}O]_{40}\text{-}(CH_2)_4\text{-}OH$$

After termination of the test, the carburetor was perfectly clean.

EXAMPLE 8

Test 1 was repeated. Instead of methanol, azeotropic ethanol was used. After termination of the test, the carburetor was perfectly clean.

In a comparative example without polyolether, deposits were found in the carburetor system.

EXAMPLE 9

Test 1 was repeated with a Mercedes-Benz 200 E. As a polyolether, 20 ppm of $$H_3C\text{-}(CH_2)_{15}\text{-}O\text{-}(CH_2\text{-}\underset{\underset{CH_3}{|}}{CH}\text{-}O)_3\text{-}H$$

was used.

After termination of the test, the injection system was perfectly clean.

In a comparative test without polyolether, deposits were observed.

Similar results were obtained with other inventive polyolethers in combination with other corrosion additives as well as other additives.

The instant invention represents an important progress with regard to alcohol fuels. The tests show that with the inventive polyolether addition, conventional, commercial lubricants can be used in alcohol-fuelled engines instead of specifically produced lubricants according to the state of the art.

We claim:

1. Process for the prevention or reduction of deposits in carburetors, injection devices or similar devices of engines, which are operated with alcohol fuels comprising 99.9 to 75 Vol.-% methanol, ethanol or a mixture thereof and at least one corrosion inhibitor, in combination with lubricants, which are suitable for engines operated with hydrocarbon fuels, characterized in that one or several polyol ethers are added to the alcohol fuels in a quantity of 15 ppm to 1 weight-%, whereby the polyol ether(s) has (have) the general formula $$R\left[\text{-}O\text{-}\underset{\underset{R_2}{|}}{\overset{\overset{R_1}{|}}{(C)_m}}\right]_n\text{-}R_3$$

wherein R is H, linear or branched $C_1$-$C_{20}$-alkyl, $C_1$-$C_{20}$-alkenyl, polyunsaturated $C_1$-$C_{20}$-alkyl, $C_1$-$C_{20}$-cycloalkyl, mono- or bicyclo-$C_6$-$C_{14}$-aryl, unsubstituted or substituted;

wherein $R_1$ is H, $C_1$–$C_8$-alkyl, unsubstituted or substituted aryl;

wherein $R_2$ is H, $C_1$–$C_8$-alkyl, unsubstituted or substituted aryl and wherein $R_3$ is $Or_5$, $SR_5$, $N(R_5)_2$, wherein $R_5$ is H, linear or branched $C_1$–$C_{20}$-alkyl, $C_1$–$C_{20}$-cycloalkyl, mono- and bicyclo-$C_6$–$C_{14}$-aryl, unsubstituted or substituted; or

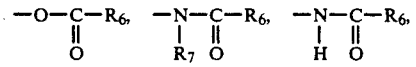

wherein $R_6$ is H, a linear or branched, saturated or unsaturated $C_1$–$C_{20}$ alkyl- and mono- or bicycloalkyl group or a substituted or unsubstituted mono- or bicycloaryl group, an unsubstituted or substituted amino group, a substituted or unsubstituted alkoxy group, a substituted or unsubstituted thioether group;

wherein $R_7$ is a linear, branched, saturated or unsaturated alkyl group, or

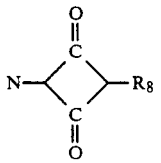

wherein $R_8$ is $R_6$ and the C=O groups are not directly interconnected or are interconnected by unsubstituted or substituted saturated or unsaturated methylene bridges consisting of 2–5 methylene groups, or phosphoric esters or thiophosphoric esters;

or alkylethylene diamine tetra acetic acid ester, amide or imide whereby m of the polyether molecule exclusively is 2 or 3 or 4 or combinations of these numbers, and n is 2–200.

2. Process according to claim 1, characterized in that the quantity of polyolether(s) in the fuel is 15 to <2000 ppm.

3. Process according to claim 1 wherein the polyolether is $H_3C$–(O—$CH_2CH_2$)$_n$–$OCH_3$.

4. Process according to claims 1 or 2, characterized in that n=2–100.

5. Process according to claims 1 or 2, characterized in that n=2–75.

6. Process according to claims 1 or 2, characterized in that $R_1$ and $R_2$=H and/or $CH_3$.

7. Process according to claims 1, 2, or 3, characterized in that the alcohol fuels contain 0.1 to 25 Vol.-% of hydrocarbons and 99.9 to 75 Vol.-% of methanol and/or ethanol.

8. Process according to claims 1, 2, or 3, characterized in that the alcohol fuels contain 1 to 25 Vol.-% of hydrocarbons and 99 to 75 Vol.-% of methanol and/or ethanol.

9. Process according to claims 1, 2, or 3, characterized in that the alcohol fuels contain 2 to 25 Vol.-% of hydrocarbons and 98 to 75 Vol.-% of methanol and/or ethanol.

10. Process according to claims 1, 2, or 3, characterized in that the hydrocarbons are $C_4$-$C_x$-hydrocarbons, wherein x is the number of carbon atoms at the upper limit of gasoline hydrocarbons.

11. Process according to claims 1, 2, or 3, characterized in that the ethanol is at least in part, water containing ethanol.

12. Process according to claims 1, 2, or 3, characterized in that the methanol is at least in part, non-distilled technical-grade methanol and/or topped technical-grade methanol.

13. Process according to claims 1, 2, or 3, characterized in that the alcohol fuels contain additionally aromatic hydrocarbons.

14. Process according to claims 1 or 2, characterized in that R is a substituent from the group H, alkyl, aryl and carboxy.

15. Process according to claims 1 or 2, characterized in that $R_3$ is a substituent from the group H, $OR_5$, $SR_5$, $NR_5H$, $N(R_5)_2$,

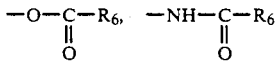

and

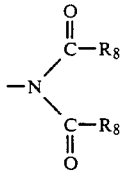

16. Process according to claim 1 wherein the alcohol fuels contain water, $C_3$–$C_{10}$-alcohols, hydrocarbons or mixtures thereof.

17. Process according to claim 1 wherein the R group of the polyol ether is substituted with OH, $OR_4$, $NH_2$—, alkylamine, SH, $SR_4$, C=N, an aliphatic carboxylic acid group, an aromatic substituted and unsubstituted carboxylic acid group, phosphoric ester group, thiophosphoric ester group or an acetal group, wherein $R_4$ is a saturated or unsaturated $C_1$–$C_{20}$-alkyl group or a substituted or unsubstituted arylgroup.

18. Process according to claim 1 wherein R is substituted with a fatty acid group.

19. Process according to claim 1 wherein the $R_3$ group of the polyol ether is substituted with OH, $OR_4$, $NH_2$—, alkylamine, SH, $SR_4$, C≡N wherein $R_4$ is a saturated or unsaturated $C_1$–$C_{20}$-alkyl or unsaturated or saturated aryl.

20. Process according to claim 1 wherein the $R_3$ group of the polyol ether is substituted with OH, $OR_4$, $NH_2$—, alkylamine, SH, $SR_4$, C≡N wherein $R_4$ is a saturated or unsaturated $C_1$–$C_{20}$-alkyl or unsaturated or saturated aryl.

21. Fuels comprising 99.9 to 75 Vol.-% methanol, ethanol or a mixture thereof which are used in combination with lubricants, which are suitable for engines operated with hydrocarbon fuels and at least one corrosion inhibitor, characterized in that the alcohol fuels contain one or several polyolethers in a quantity of 15 ppm up to 1 weight-%, whereby the polyolether(s) has (have) the general formula

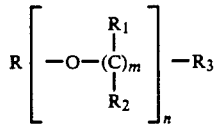

wherein R is H, linear or branched $C_1$–$C_{20}$-alkyl, $C_1$–$C_{20}$-alkenyl polyunsaturated $C_1$–$C_{20}$-alkyl, $C_1$–$C_{20}$-cycloalkyl, mono- or bicyclo-$C_6$-14 $C_{14}$-aryl, unsubstituted or substituted;

wherein $R_1$ is H, $C_1$–$C_8$-alkyl, unsubstituted or substituted aryl;

wherein $R_2$ is H, $C_1$–$C_8$-alkyl, unsubstituted or substituted aryl and wherein $R_3$ is $Or_5$, $SR_5$, $N(R_5)_2$, wherein $R_5$ is H, linear or branched $C_1$–$C_{20}$-alkyl, $C_1$–$C_{20}$-cycloalkyl, mono- and bicyclo-$C_6$–$C_{14}$-aryl, unsubstituted or substituted; or

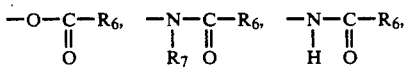

wherein $R_6$ is H, a linear or branched, saturated or unsaturated $C_1$–$C_{20}$ alkyl- and mono- or bicycloalkyl group or a substituted or unsubstituted mono- or bicycloaryl group, an unsubstituted or substituted amino group, a substituted or unsubstituted alkoxy group, a substituted or unsubstituted thioether group;

wherein $R_7$ is a linear, branched, saturated or unsaturated alkyl group, or

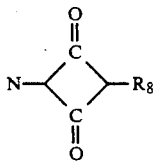

wherein $R_8$ is $R_6$ and the C=O groups are not directly interconnected or are interconnected by unsubstituted or substituted saturated or unsaturated methylene bridges consisting of 2–5 methylene groups, or phosphoric esters or thiophosphoric esters;

or alkylethylene diamine tetra acetic acid ester, amide or imide whereby m of the polyether molecule exclusively is 2 or 3 or 4 or combinations of these numbers, and n is 2–200.

22. Fuels according to claim 21, characterized in that the quantity of polyolether(s) in the fuel is 15 to <2000 ppm.

23. Fuels according to claim 21 wherein the polyether is $H_3C$-(-O—$CH_2CH_2$)$_4$-$OCH_3$.

24. Fuels according to claims 16 or 17, characterized in that n=2–100.

25. Fuels according to claims 16 or 17, characterized in that n=2–75.

26. Fuels according to claims 16 or 17, characterized in that $R_1$ and $R_2$=H and/or $CH_3$.

27. Fuels according to claims 16, 17, or 23, characterized in that the alcohol fuels contain 0,1 to 25 Vol.-% of hydrocarbons and 99.9 to 75 Vol.-% of methanol and/or ethanol.

28. Fuels according to claims 16, 17, or 23, characterized in that the alcohol fuels contain 1 to 25 Vol.-% of hydrocarbons and 99 to 75 Vol.-% of methanol and/or ethanol.

29. Fuels according to claims 16, 17, or 23, characterized in that the alcohol fuels contain 2 to 25 Vol.-% of hydrocarbons and 98 to 75 Vol.-% of methanol and/or ethanol.

30. Fuels according to claims 16, 17 or 23, characterized in that the hydrocarbons are $C_4$-$C_x$-hydrocarbons, wherein x is the number of carbon atoms at the upper limit of gasoline hydrocarbons.

31. Fuels according to claims 16, 17 or 23, characterized in that the ethanol is at least in part, water containing ethanol.

32. Fuels according to claims 16, 17, or 23, characterized in that the methanol is at least in part, non-distilled technical-grade methanol or topped technical-grade methanol.

33. Fuels according to claims 16, 17, or 23, characterized in that the alcohol fuels contain additionally aromatic hydrocarbons.

34. Fuels according to claims 16 or 17, characterized in that R is a substituent from the group H, alkyl, aryl and carboxy.

35. Fuels according to claims 16 or 17, characterized in that $R_3$ is a substituent from the group H, $OR_5$, $SR_5$, $NR_5H$, $N(R_5)_2$,

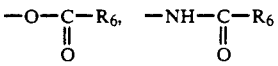

and

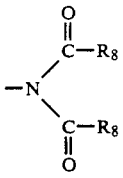

36. Fuels according to claim 21 further containing water, $C_3$–$C_{10}$-alcohols, hydrocarbons or mixtures thereof.

37. Fuels according to claim 21 wherein the R group of the polyol ether is substituted with OH, $OR_4$, $NH_2$—, alkylamine, SH, $SR_4$, C=N, an aliphatic carboxylic acid group, an aromatic substituted and unsubstituted carboxylic acid group, phosphoric ester group, thiophosphoric ester group or an acetal group, wherein $R_4$ is a saturated or unsaturated $C_1$–$C_{20}$-alkyl group or a substituted or unsubstituted arylgroup.

* * * * *